United States Patent [19]

Astle et al.

[11] 4,302,016

[45] Nov. 24, 1981

[54] COMMUNITY DEVELOPMENT EDUCATIONAL APPARATUS

[76] Inventors: Brian Astle, 22 Fieldstone Rd., Princeton Junction, N.J. 08550; P. Christopher J. Gallagher, 107 Kingsway Common, Princeton, N.J. 08540

[21] Appl. No.: 20,183

[22] Filed: Mar. 13, 1979

Related U.S. Application Data

[63] Continuation-in-part of Ser. No. 776,476, Mar. 10, 1977, abandoned.

[51] Int. Cl.[3] ..... A63F 3/00

[52] U.S. Cl. ..... 273/278

[58] Field of Search ..... 273/256, 290, 278, 236, 273/256

[56] References Cited

U.S. PATENT DOCUMENTS

| | | | |
|---|---|---|---|
| 1,346,826 | 11/1920 | Huggins | 273/248 |
| 2,026,082 | 12/1935 | Darrow | 273/256 |
| 2,723,857 | 11/1955 | Miller | 273/254 |
| 3,801,104 | 4/1974 | Potts | 273/239 |
| 4,079,941 | 3/1978 | Morales | 273/290 |

*Primary Examiner*—Richard C. Pinkham
*Assistant Examiner*—Carl Moy
*Attorney, Agent, or Firm*—Gary M. Nath

[57] ABSTRACT

A board game method involving community development skills between parcels of land and diverse structural improvements thereon with respect to income, expense, and financing thereof during successive time periods of indefinite duration wherein selective positional association of markers of varying sizes and characters upon uniform land areas has a direct bearing on relative success or failure in boom or bust periods. The periods during which action is taken vary randomly throughout utilization of the game device, thus enabling continuous application of strategy and skill in acquiring and arranging land parcels and markers thereon to cope successfully with the unexpected end of a time period.

5 Claims, 3 Drawing Figures

COMMUNITY DEVELOPMENT EDUCATIONAL APPARATUS

This is a continuation-in-part application of application, Ser. No. 776,476, filed Mar. 10, 1977 now abandoned.

The invention relates generally to games, and in particular to a board game apparatus involving community development of parcels of land with multiple structural improvements.

Many board games have some relationship to possible actual events or with educational features related thereto. Such games commonly rely upon movable markers representing the players and wherein movement is usually a function of a chance numerical device such as dice or a spinner. Examples of such games include those commonly known as "Monopoly", "Easy Money", and the like.

Such prior art games although instructive and enjoyable with respect to the handling of money, property, legal relationships and the like, are frequently characterized by an adversary or combative player-to-player theme wherein a roll of the dice determines whether one player becomes indebted to or overcome by another.

The present invention relates to a board game involving skill and strategy having educational and instructional value with respect to the acquisition of parcels of land with a view toward community development and interrelationship of diverse enterprises such as industry, housing, service establishments, commercial establishments, and office buildings, among other possibilities.

In contrast to many prior art games, the subject game device is essentially non-combative or adversary in character wherein one player vies against another or all of the others. Rather, the board and associated markers of the present invention are so related in the use of the device that each player or user seeks to enhance their financial status by individual efforts and by cooperation with other players in improving land areas within larger land parcels.

In addition to the challenge presented by selective topological utilization of markers representing differing cultural improvements with respect to existing markers of the user or those of another player to maximize interaction of the community, the markers themselves represent cultural improvements of varying size. Proper and judicious selection of an appropriate size marker in particular circumstances also has a direct bearing upon the success of the individual in preserving and protecting the land we well as cooperating in building a diverse, and financially stable interrelated community.

Additionally, there is provided customary game indicia to indicate acquisition of property, as title deeds and various denominations of money for use in effecting exchanges of value. Further, there is also the provision of evidences of loan indebtedness of two characters, namely, secured and unsecured loans. As in real life, the secured loans are more difficult to obtain but present less burden on the borrower in contrast to unsecured loans which are relatively easy to obtain but represent a significant financial burden which increases markedly so long as the same remains unpaid by the borrower.

Further, indicia means in the nature of cards describe action to be taken by the players, such as "Collect Rent", "Pay Loan Interest", etc. These action cards may include a second group designating a particular land parcel subject to the action required, thus compounding the interplay variables.

Finally and importantly, in enhancing the instructional or teaching aspects of the game device, the interrelationships of income, expense, and financial dealings are subject to a major variable in the nature of successive time periods of uncertain length. Thus, each player in addition to the topological or community development aspects is required to coordinate game strategy to protect individual financial status in multiple years, such years may be lean or may be unexpectedly cut short from an income standpoint or may even be years of increased financial potential. This random variation in the time periods within which predetermined events are to occur with respect to the utilization of the diverse markers representing building structures on the board uniquely permits each successive time period in a given play of the game to differ from other or previous time periods of play whereby the element of sustained player skill is a formidable factor. The time period for successive periods is terminated by randomly interspersing a specific card to that effect among various action cards.

The present invention provides a board game method characterized by the development of land on a community basis, specifically to learn and seek to effect diverse and interrelated improvement of land not only on one's own parcels but also by cooperative relationships with improvements upon adjacent properties of others.

The present invention also enables the development and strategies in community development to be counterbalanced against factors which are not player-related but rather may be ordinarily expected in business life, such as good years of income and profit reflecting relative success, or a bad year of unforeseen high expense with concomitant ecomonic difficulty.

In particular, the present invention involves a game method simulating land development comprising a board having a perimeter defined thereon and divided into multiple parcels, said parcels being identified differently and each of said parcels containing at least one uniform area representing a land unit; a plurality of distinctive markers representing building structures; means for permitting acquisition of said parcels and markers; a set of action cards having data thereon pertaining to conditions for determining income and expense for said parcels and markers thereon; a means for identifying successive time periods; and a time period defining means for signaling the termination of a given time period and commencement of a subsequent time period, said time period defining means comprising a specific card randomly dispersed with said action cards.

A better understanding of the invention may be had with reference to the accompanying drawings, in which.

Figure 1:
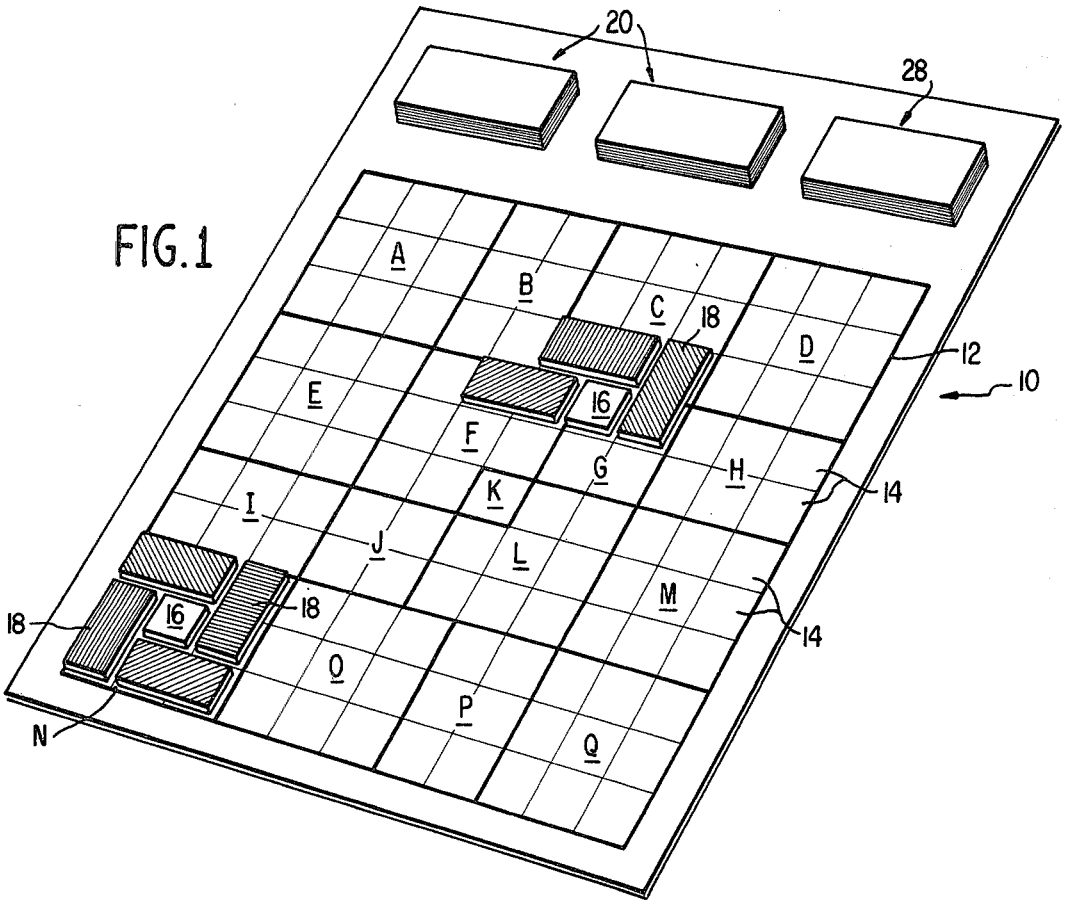
FIG. 1 is a perspective view of the game board of the invention showing illustrative positions of markers thereon in community development.

More particularly, and referring to the drawings, the invention includes a game board 10 of relatively rigid material and which for convenience may be hingedly folded along a midline thereof for compact storage. The major area of board 10 defines a perimeter 12 which is subdivided therewithin into a plurality of adjacent areas of varying size at A, B, C, etc., which define land parcels of varying size. While letters have been assigned to the parcels for ease of description, other conventional designations, as by name or color, may be employed and preferably realistic or fanciful names may be used such as "Willow Grove", "Sleepy Hollow", "Spring Clearing", "Cherry Orchard" and the like.

Further, each of the several land parcels A, B, and so forth, contain at least one uniform area 14 of uniform size. These uniform areas which represent a land unit may conveniently be deemed "acres."

In a preferred array of the land parcels it will be seen that the land units are arranged in rows and files delineating an 11×11 square totalling 121 uniform areas as at 14 in all. Further, the preferred arrangement of the several land parcels to maximize the interrelationships taught by the game device provides eight parcels which have 9 units, respectively, namely parcels, A, C, D, E, M, N, O and Q. There are four six-unit parcels about the periphery, namely at B, H, I and P, which together with the aforementioned larger parcels form a surrounding boundary for the central parcels.

The central parcels include two eight-unit L-shaped parcels F and L, two four-unit parcels G and J, and a single unit central parcel at K.

The topological pattern of the game board is designed to satisfy several requirements for effective community development, such as by favoring cooperative building on adjoining sites by useage of straight boundaries between land parcels. This topological pattern enables a particular parcel owner to anticipate the building patterns on distant parcels and thus permits synergistic development. In the most preferred layout, large parcels have been placed at the edges and corners of the game board since these have fewer sides available for cooperative building to render them favorable for acquisition because of their increased size. In contrast, smaller parcels and less regular parcel boundaries have been placed toward the center which aids in maintaining the value per area within different parcels within reasonable limits.

Used in conjunction with the land parcels and particularly the uniform areas 14 thereof are a plurality of markers. Preferably, as at 16 and 18, the markers are of at least two differing sizes. The markers 16 are of a size to fit conveniently within a single uniform area 14 and may be conveniently of substantially square configuration. The markers 18 are of larger size, specifically to overlie two adjacent laterally aligned uniform areas 14 in a row or file and are thus oblong or rectangular in a convenient form. Other means of distinguishing the markers may be utilized.

Figure 3:
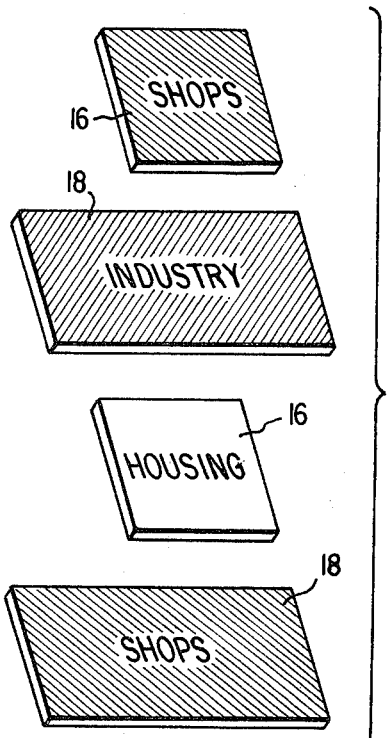

Further, as a chief feature in the instructional relationships achieved by the device of the present invention, the several markers 16, 18 are each respectively of a plurality of different types as also indicated in FIG. 3. In each instance, a marker represents a different building structure characteristic of improvement upon the land and has concomitantly in the utilization of the game device an income and expense property unique thereto. The expense property of the different structures is distinct from the income and expense value of unimproved or farmable land parcels, that is, undeveloped parcels.

In a preferred embodiment of the invention, the several markers of all sizes as at 16, 18, selectively identify five different improvements, namely housing, services, shops, offices, and industry. Suitable legends may be imprinted upon the markers or they may be suitably configured to readily differentiate the several types. Structural objects simulating actual buildings may also be conveniently employed.

An effective way of indicating the differentiation of the land improvements is by color coding as shown in the drawings, whereby at a glance the topological relationships between differing improvements upon uniform areas 14 of land parcels 12 as shown in A and B can be readily determined by the colors of the markers. Such color designation may for convenience be red for housing, yellow for shops, orange for services, blue for offices, and brown for industry. The selection of different markers, wherein the players can use any or all differing markers enhances the fundamental topological significance of the board since income from development is dependent upon the number of different markers contiguous to the individual players' markers. This arrangement thus emphasizes the interdependence of multiple structures in land development.

In effecting interplay of the land parcels and the markers, means are provided for assessing income and expense for the several parcels or developed uniform area thereof.

Figure 2:
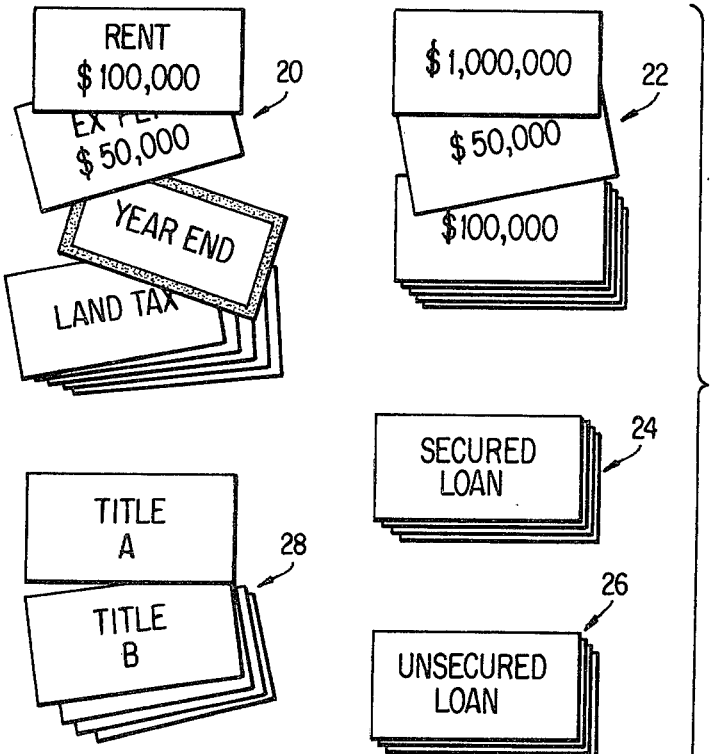
FIG. 2 is illustrative of diverse indicia means employed with the game device to provide interaction between board and marker components; and, FIG. 3 is a perspective view illustrating typical differing types of markers employed with the game board.

This is conveniently effected by indicia in the form of individual printed cards as at 20, FIG. 2, which contain diverse instructions relevant to action to be taken regarding income, expense and financial matters affecting the land or its developed uniform areas as may be acquired or obtained by the participants in the game device. Thus, illustratively, the action cards 20 may recite "Rent Payable—$100,000", "Highway Construction—Improvements to be Demolished", or "Industrial Tax" and so forth. Further, to compound the interaction, the cards 20 may be of two characters divided into two piles as seen in FIG. 1 wherein one pile may indicate the action to be taken and the second pile may specify the particular yearly time period, acquisition of parcels and/or taxation assessment values for parcels and developed areas.

In a preferred embodiment of the invention, the land tax is permitted to progressively increase throughout successive business years, that is time periods. In this manner, economic inflationary tendencies common in a sequence of business years are simulated. Such increases affect a player's development stretegy for investment plans, such that taxation may result in loss of parcel property rights without other player interaction.

To facilitate the utilization thereof, there is also provided conventional indicia 22 in the nature of money in denominations as might be expected in handling major land transactions, erection of shopping centers, and so forth. Further there is also provided a plurality of printed indicia 24, 26 of varying types which represent loan advances preferably of both secured and unsecured character. Further compounding of the land development relationship is provided by the loan advances wherein secured loans 24 may be readily obtained but only if backed by specific structural improvements designated by markers 16, 18, while unsecured loans 26 may be obtained without security but at the cost of high interest payable on demand which may occur at an unpredictable time interval.

A further supply of printed members 28 conveniently indicate titles, deeds, or other comparable ownership indicia with respect to the several land parcels 12.

A unique and special feature of the game device lies in the inclusion of action cards 20 of one particular card determining termination of a given time period, and commencement of a subsequent time period until the last time period is obtained. Such a card may be conveniently called an "End of Year" card as shown in FIG. 2. This single card when shuffled and interdispersed with other action cards 20 will lie at a random point in the stack of action cards and thus may be the first to be drawn, the very last, or at any point therebetween. Exhibition of this card effects termination of a given time period or business year, whereupon annual taxes must be paid, interest on loans made current, and like matters. Strategy in play of the game in acquiring land parcels, erecting improvements, borrowing money, and the like becomes heavily dependent upon the close of a time period or "End of the Year". This randomness causes relative "boom" and "bust" years as are commonly experienced in real life with war, energy crises, or weather hazards and demand careful play on the part of a user to avoid financial embarrassment or indeed, bankruptcy.

The board 10 may be conveniently imprinted to receive the instruction or action cards 20 amd title cards 28 while the money denominations 22 and loan evidences 24, 26 may be separately placed to one side of board 10 for distribution to the participants in the game device by a banker or the like in accordance with a playing scheme.

Inasmuch as it is a chief function of the instant game device to teach the meritorious and advantageous relationships of having diverse and multipurpose development of land areas, it will be evident that the provision of the two differing sizes of markers 16, 18 on the rectilinear board as subdivided into the plural individual uniform areas 14 permits the markers 16, 18 in any one land parcel as at N to be grouped with markers of diverse characters or color shading adjacent each other to a maximum extent. Thus, in parcel N, a central single-acre marker 16 is surrounded by 2-acre markers 18 each of a differing character, whereby the marker 16 is laterally adjacent markers of four other types, while all other markers 18 are laterally adjacent three other marker types. Income, such as profits and rents from action cards 20 is dependent upon the multifarious development of a land parcel.

In like manner, as is evident in land parcels C, F, and G, the markers 16, 18 may be juxtaposed for adjacent contact not only within a given land parcel but also with respect to markers in an adjacent parcel as will be seen thereat. Further, a larger size marker 18 encompassing more than one of the subdivided uniform land areas 14 may extend betweeen adjacent parcels if commonly owned so as to overlie a uniform area 14 in each of two different parcels, as in parcel C and G.

In the utilization of the game device, the land parcels are acquired in accordance with a set of rules and are suitably evidenced as by the title cards 28. Further, the provision of money 22 both in accordance with rules of play and instructions on the diverse printed action cards 20 permit the markers 16, 18 to be arranged in a selective manner by a participant upon parcels of land to which he has a title card 28 as well as sufficient funds therefor in the form of money 22 or loan notes 24, 26.

Inasmuch as a smaller marker 16 will fit in any uniform area 14 while the larger markers 18 will occupy two such areas and may be arranged in rows or files as illustrated, considerable freedom is given to a game participant to elect the orientation of the markers 16, 18 and the differing character thereof as conveniently evidenced by the color differences thereon.

The instructions on card 20 and the regime or play maximize the returns to those with a maximum of diverse development of a land parcel or adjacent land parcels. That is to say, a community comprising solely "shops" is not as desirable as a community comprising adjacent and interrelated improvement units including industry, services, housing, and offices, as well as shops, for example. This interplay and interchange in real life between diverse interests, talents and abilities is reflected in the subject game device by providing greater rewards for such diverse development whether commonly owned or owned by others in adjacent relation Therefore, it behooves the participant to effect arrangement to the extent his ability and skill permits of diverse types of markers 16, 18 in a topological pattern as suggested in FIG. 1.

It follows, consequently, that if parcel F, for example, is owned by one player, and is improved with an industry marker 18 as seen in FIG. 1, a second player owning both parcels C and Q will elect with his money available or borrowed to improve parcel C thereby to place a marker adjacent that in parcel F to gain the benefit of diverse interaction in a geographically related community even though owned by another.

PREFERRED RULES OF PLAY

In starting the game, a player is appointed banker and another player is appointed auctioneer. Both functions may be conveniently performed by a single player. Each player is given an allotment of money of suitable denominations. The auctioneer then auctions various parcels using an appraised value assigned for the parcel being auctioned as a guide for its probable selling price, such as with Title cards. After all of the parcels selected by the auctioneer have been sold with each player making purchases using his best judgment as to location, and value of money, the players are given the opportunity to purchase markers, that is structural buildings for erection on the players previously purchased parcel. When all players have had their opportunity to errect markers, which they execute at their own discretion, the first player draws the top card of previously shuffled action cards and reads its message aloud. For the majority of the cards, all players may be involved in the ensuing action, that is receiving rental income, or paying taxes. Other action cards concern the active player only, such as extra rental income, or preferred bank loan relief. Where more than one player is involved in action, business is completed first by the active player and then with each player progressing clockwise. Upon completing the play, the card is replaced under the action card pile which is passed clockwise for the next player's turn.

Income is payable by the BANK to owners of buildings when the appropriate action card is drawn. The amount of income being dependent upon the quality of the players' community developments measured by the number of adjacent, that is contiguous, markers (building structures) next to the marker identified by the active card. A monetary bonus may optionally be paid for markers which are contiguous with all four other types of markers, with the absence of rent on completely isolated buildings. All buildings whether owned by the active player or by other players are considered equally in determining rental income.

Play proceeds until the "END OF YEAR" card terminating a business year is drawn. When drawn, the instructions involving ensuing action are followed, such as payment of particular loans acquired by individual players. Exhibition of this card terminates a given time period or business year, such as YEAR 1 whereby the YEAR 2 play commences. Regular play proceeds again until the "END OF YEAR" card is drawn, evidencing conclusion of the year. In the preferred rules, 10 full years are completed until completion of the game.

The action cards including the "END OF YEAR" card, following termination of each year, are shuffled and placed in readiness of the next year. Additional action cards may be added in preparation for the next year to enhance active play. As a result of the process, expense and income action which has taken place already in a prior year can once more occur on a random basis. In addition, action cards which lay beneath the "END OF YEAR" card in the previous year which did not come into play gain the same chance as the other action cards being played in the upcoming year. Players must adjust their strategies in any given year as specific action cards are drawn. For example, it is preferable to erect houses on uniform areas after a card requiring taxation, such as a specific "Housing Tax" card has been played in any given year, but before another card granting income such as before a "Housing Rent" card is drawn.

According to the preferred rules of the game, markers (building structures) are of two sizes, 1 acre or 2 acres, and are of five different types. The cost of a building may be uniform regardless of size or type. The benefit from building is the rental income paid when the appropriate action card is drawn. The buildings may not be moved to other parcels or within the same parcel to other uniform areas. They may be demolished. When demolished, the BANK pays a specific amount, normally one-fifth of the purchase value, for each. Buildings may be placed only on land that the player owns and are determined fixed when an action card is drawn subsequent to their erection. Two acre buildings may be placed across the boundary lines of adjacent plots owned by the same player.

No provision is made in the game equipment for distinguishing the buildings owned by different players from one another.

Low risk bank loans may be procured equal in value to the cost of a single building when a multiple, such as three, existing buildings are used as security for the indebtedness. An interest rate may be assigned such loans, such as 10% per game year.

High risk loans may be procured on demand where no collateral is required. Such loans may be obtained by any player not having the necessary cash to conduct business at any time for any purpose, but such loans must be expended during the same turn they are received. A high interest rate may be assigned such loans, such as 100% per year due when the END OF YEAR card is drawn. For convenience, both types of loans are handled by the banker.

It is not necessary to provide further details required by the rules regarding loans. Such loans may be varied widely within the scope of the invention.

A player will be placed in bankruptcy if he cannot pay a debt to another player or to the bank with cash on hand or by raising cash from loans or demolishing buildings. Loans may not be made from one player to another nor may settlement of debts be deferred. Play continues as long as one player remains solvent.

The game is won outright by the player still solvent if all others have become bankrupt. In games lasting the full successive time periods, such as 10 game years, the winner is the player with the greatest net assets. The term net assets may vary within the scope of the invention and is accordingly not intended to be limiting thereof.

The invention being thus described, it will be apparent that the same may be varied in many ways, such variations are not to be regarded as departures from the spirit and scope of the invention as set forth in the claims.

We claim:

1. A method of playing a board game for a plurality of players which comprises the steps of:

(a) providing a board having a perimeter defined thereon and divided into multiple parcels having different designations to constitute distinguishable groups, each parcel containing at least one uniform area representing a land unit and providing a supply of script money;

(b) each of said players selecting a different parcel;

(c) providing a plurality of distinctive markers representing building structures for selective positional association with said uniform areas, said distinctive markers divided into a plurality of groups;

(d) each of said players purchasing said markers for placement on previously acquired parcels;

(e) selectively positioning purchased markers on one or more of the said uniform areas in one or more of the previously purchased parcels during a player's turn in either a contiguous or noncontiguous relationship to permit maximization of different types of markers in juxtaposed position;

(f) selecting by chance a player-action-valuation item from a plurality of card packs, one set containing title cards having data thereon expressing values applicable for the acquisition of said parcels, one set containing action cards having data thereon containing conditions for determining income, expense and various business activities for said parcels and marker-denoted improvements, and one set identifying successive time periods corresponding to years, upon the drawing of at least some of the action cards, performing the step of distributing script money to a player, the amount of script money distributed being a function of the number of dissimilar building structures currently owned by that player placed contiguously to each other, such that a greater number of dissimilar building structures placed contiguously yields a distribution of a larger amount of script money;

(g) repeating steps (d) through (f) until a time period defining means comprising an end of year card randomly dispersed and visually non-ascertainable within said action cards is drawn to determine completion of a particular time period; and (h) repeating steps (d) through (g) for a preselected number of time periods.

2. The game method of claim 1 wherein a player disposes said markers on said board within a single parcel completely occupying one or two uniform areas or extend between two contiguous parcels to occupy one uniform area in each parcel.

3. The game method of claim 1 wherein a player selects one of several distinctive markers denoting different types of structures for selective association with said uniform areas, each player being entitled to acquire multiple types of markers.

4. The game method of claim 1 wherein a player may place a marker on a uniform area in one parcel which is disposed laterally adjacent another marker on the same or another parcel in a row or file to enable community grouping of said markers.

5. The game method of claim 1 wherein said means for indicating successive time periods constitutes a stacked plurality of cards containing data thereon concerning taxation valuations and parcel acquisition.

* * * * *